US005595479A

United States Patent [19]

Hansen et al.

[11] Patent Number: 5,595,479

[45] Date of Patent: Jan. 21, 1997

[54] HYDRAULIC MACHINE HAVING TEETH FORMED BY ROLLERS

[75] Inventors: Gunnar L. Hansen; Hans C. Petersen, both of Nordborg, Denmark

[73] Assignee: Danfoss A/S, Nordborg, Denmark

[21] Appl. No.: 535,009

[22] PCT Filed: Mar. 24, 1994

[86] PCT No.: PCT/DK94/00123

§ 371 Date: Nov. 27, 1995

§ 102(e) Date: Nov. 27, 1995

[87] PCT Pub. No.: WO94/23205

PCT Pub. Date: Oct. 13, 1994

[30] Foreign Application Priority Data

Apr. 5, 1993 [DE] Germany ..... 43 11 166.1

[51] Int. Cl.[6] ..... F03C 2/08; F04C 2/10

[52] U.S. Cl. ..... 418/61.3

[58] Field of Search ..... 418/61.3, 113, 418/116, 125, 225, 227

[56] References Cited

U.S. PATENT DOCUMENTS

| | | | |
|---|---|---|---|
| 3,591,320 | 7/1971 | Woodling | 418/61.3 |
| 3,917,437 | 11/1975 | Link | 418/61.3 |

FOREIGN PATENT DOCUMENTS

| | | | |
|---|---|---|---|
| 2140962 | 3/1973 | Germany . | |
| 819449 | 4/1981 | U.S.S.R. | 418/61.3 |
| 602836 | 6/1948 | United Kingdom . | |

*Primary Examiner*—John J. Vrablik

*Attorney, Agent, or Firm*—Lee, Mann, Smith, McWilliams, Sweeney & Ohlson

[57] ABSTRACT

A hydraulic machine is disclosed, having an annular gear with internal teeth and a gearwheel with external teeth mounted eccentrically therein, the internal teeth comprising one more tooth than the external teeth and the teeth of at least one set of teeth being formed by rotatably mounted rollers. It is desirable in such a machine for the internal seal to be improved and wear to be reduced. To that end, each roller has in its surface at least three axially parallel recesses, in which the teeth of the other set of teeth engage.

9 Claims, 1 Drawing Sheet

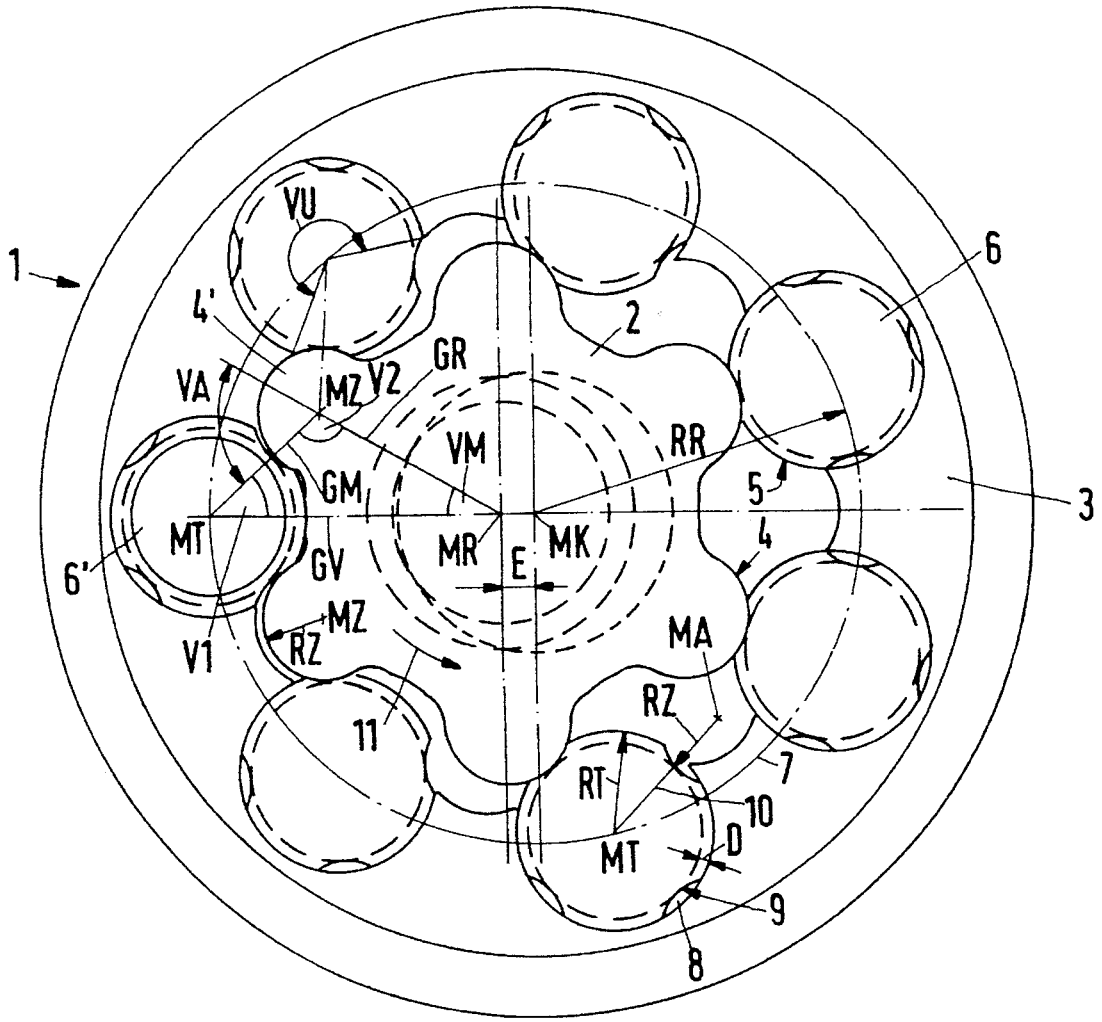
1
VU
4'
VA
MZ
V2
GR
2
6
VM
RR
GM
5
3
MT
MR
MK
4
6'
GV
E
MZ
V1
RZ
MA
RZ
11
7
RT
10
MT
D
9
8

HYDRAULIC MACHINE HAVING TEETH FORMED BY ROLLERS

The invention relates to a hydraulic machine having an annular gear with internal teeth and a gearwheel with external teeth mounted eccentrically therein, the internal teeth comprising one more tooth than the external teeth and the teeth of at least one set of teeth being formed by rotatably mounted rollers. A hydraulic machine according to the invention may operate as either a pump or a motor.

In a known machine of this kind (DE-OS 21 40 962) the tooth tips are subjected to relatively intense wear and tear because the tooth tips of gearwheel and annular gear slide on one another during the relative movement of gearwheel and annular gear. The co-operating teeth of gear wheel and annular gear form individual pressure chambers. Greater wear occurs in the regions of the chambers at low pressure because the teeth of the gearwheel are here pressed additionally by the higher pressure on the opposite side against the teeth of the annular gear. To reduce wear, the teeth of the annular gear are in the form of rotatably mounted rollers. The rotatable mounting can very quickly lead, however, to slight play between rollers and annular gear, which in turn causes leakage between individual pressure chambers which are formed by the co-operation of the teeth of the annular gear and the gearwheel. To reduce the play and facilitate rotation of the rollers, and consequently to decrease the slip between gearwheel and the rollers, each depression in which a roller is mounted is supplied with oil under pressure, so that between the roller and its recess a film of oil forms, which improves the seal and increases the mobility of the roller. Although virtual freedom from slipping and therefore a reduction in wear is achieved by this measure, wear still remains considerable because it is precisely in the region in which the teeth of gearwheel and annular gear together separate a chamber of higher pressure from a chamber of lower pressure that the seal is formed by two opposing convex surfaces, namely the tooth tips. Contact here is therefore virtually only a line contact, in which a tight seal can be achieved only at the cost of a relatively large pressure with which the two tooth tips are pressed against one another. The inner seal is a parameter determining the efficiency of the pump.

GB 602 836 describes a hydraulic machine of a different type with a rotatable rotor which is centrally mounted in a bore of a stator, an annular space being formed between the rotor and stator. Two diametrically opposite projections project from the rotor into this annular space as far as the inner wall of the stator, against which they rest. Mounted rotatably in the stator are gearwheels which together with the projections define a pair each of suction chambers, neutral chambers and pressure chambers. The gearwheels have recesses which take up virtually half of their volume. The gearwheels are driven synchronously by the rotor, which for that purpose has external teeth, so that the recesses open the way at the right time for the projections to travel past.

The invention is based on the problem of providing a hydraulic machine which achieves a relatively good inner seal combined with relatively low wear.

This problem is solved in a hydraulic machine of the kind mentioned in the introduction in that each roller has in its surface at least three axially parallel recesses in which the teeth of the other set of teeth engage.

These recesses have several advantages. Firstly, they allow a better seal between the teeth of one part and the rollers of the other part. Two convex surfaces, which permit only line contact, are no longer positioned opposite one another. On the contrary, a convex surface is now positioned opposite a concave surface, so that the seal is in fact formed by face-to-face contact. The drive of the rollers is no longer effected by friction. On the contrary, the rollers engage with the opposing teeth and are therefore driven directly. As the rollers rotate, the recesses moreover also transport hydraulic fluid, which is consequently forced to enter the region between the roller and its bearing and thus ensures self-lubrication. The recesses not only therefore improve the seal and thus the volumetric efficiency, they also reduce friction, which contributes to a reduction in wear and also to a reduction in power loss.

In a preferred construction, each recess is bounded by a surface which corresponds essentially to a part of a cylinder envelope. The midpoint of the associated cylinder lies on a radial ray. The construction as a cylinder envelope means that the characteristic of the sealing face on the roller becomes independent of the angular position of the roller, so that a constant seal can be guaranteed over the entire partial rotation of the roller.

It is here especially preferred for the teeth of the other set of teeth to have convex part-cylindrical tips, the radius of the cylindrical envelope of the recesses corresponding to the radius of the cylinder. In this construction, the tooth tip turns, on rotation of the roller, in the recess, with the result that the sealing properties remain virtually unchanged throughout the entire movement. A convex surface lies against a concave surface, the radii of the two surfaces being the same. The seal is therefore here effected by a relatively long area of contact between the external teeth and the internal teeth, which allows an excellent seal to be obtained.

Advantageously, the depth of the recesses is maximally 10% of the radius of the rollers. The rollers thus maintain a satisfactory mechanical stability. Nevertheless, a satisfactory seal at the points of contact between external teeth and internal teeth is guaranteed.

In an advantageous construction the rollers are arranged in an annular gear. The rollers can be more easily held in an annular gear.

The product of the number of recesses per roller and an angle which, when the gearwheel and annular gear are positioned so that a connection of the roller midpoint and the gearwheel midpoint lies exactly halfway between two external teeth, is formed between the connection of the roller midpoint and the gearwheel midpoint on the one hand and the connection of roller midpoint and the midpoint of the cylinder defining the tooth tip, is preferably exactly 180°. In that case, there is a sufficient number of recesses to guarantee a tight seal for all external teeth. Conversely, not too many recesses are provided for the bearing characteristics of the roller in the annular gear to be impaired.

Advantageously, the number of teeth of the gear wheel is at least double the number of recesses per roller divided by two less than the number of recesses per roller. In this manner an optimum match between the number of external teeth and the number of recesses is achieved.

Preferably, at least four of the recesses per roller are provided, each roller being received over more than 180° of its circumference by the annular gear. The number of recesses must be as small as possible in respect of the bearing surface of the rollers. On the other hand, one must ensure that each external tooth is able to engage with a recess. Because the rollers are held over more than 180° of their circumference, secure mounting of the rollers in the annular gear is achieved. Despite the four recesses, there is no danger of the rollers falling out of the annular gear.

Advantageously, the roller radius is in the range of 3.5 to 4.5 times the spacing of the midpoints of the annular gear and gearwheel. In other words, the roller radius is about 3 to about 4.5 times the eccentricity. As a result, on the one hand the rollers are large enough to fulfil the necessary sealing function, but on the other hand they are also small enough to allow adequately extensive formation of pressure chambers between the internal teeth and external teeth.

Advantageously, at least six external teeth are provided. This allows the necessary engagement of the external teeth in the recesses.

The invention is described hereinafter with reference to a preferred embodiment in conjunction with the drawing. The single FIGURE shows a diagrammatic representation of a hydraulic machine in cross-section.

A hydraulic machine 1 has a gearwheel 2 and an annular gear 3. The gearwheel 2 is eccentrically mounted in the annular gear 3, that is, the midpoint MR of the gearwheel is offset with respect to the midpoint MK of the annular gear by an eccentricity E. The gearwheel 2 has six external teeth 4. The annular gear 3 has seven internal teeth 5, which are in the form of rollers 6. The annular gear 3 therefore always has one more tooth than the gearwheel 2. The center of the gearwheel 2 moves eccentrically on a circle about the center of the annular gear 3 and at the same time rotates about its own center in an orbital movement. As is well known in the art, one of the gearwheel 2 or the annular gear 3 may be stationary, and the other rotates and orbits; or one may be orbiting and the other rotating.

The midpoints of the rollers 6 are arranged on a circle 7 of radius RR, which concentrically surrounds the midpoint MK of the annular gear 3. The rollers 6 are rotatably mounted in the annular gear 3, each roller 6 being surrounded over more than 180° of its circumference by the annular gear 3, as illustrated by way of example by the angle VU.

The rollers 6 are all of identical construction. They have a radius RT. Four recesses 8 are distributed uniformly over the circumference. The recesses have a maximum depth D which is at most 10% of the radius RT of the rollers 6. The recesses 8 are bounded by a surface 9 which is part of a cylindrical envelope. The cylinder producing the surface 9 has a midpoint MA which lies on a radial ray 10 starting from the midpoint MT of the rollers 6. The cylinder has a radius RZ.

At least in the region of the tooth tips, that is to say, in the region in which the external teeth 4 come into contact with the internal teeth 5, the shape of the external teeth 4 is likewise formed by a part of an envelope of a cylinder of midpoint MZ and radius RZ. The radius RZ of this cylinder is the same as the radius RZ of the cylinder of midpoint MA defining the recess 8. Both cylinders run axially parallel, so that both the recesses 8 and the external teeth 4 run axially parallel.

In the position illustrated, the gearwheel 2 is in a position in which a straight line GV, on which both the midpoint MR of the gearwheel and also the midpoint MT of the roller 6' furthest to the left lie, is positioned exactly half way between two external teeth. For this roller 6', a further straight line GM is drawn, which joins the midpoint MT of the roller 6' and the midpoint MZ of the external tooth 4' together. Finally, a straight line GR is drawn for this external tooth 4' on which the midpoint MR of the gearwheel 2 and the midpoint MZ of the external tooth 4' lie. V2 forms an angle of a triangle which is bounded by the straight lines GR, GM and GV. V2 is always 90° or larger. This triangle has a further angle VM in the region of the midpoint MR of the gearwheel 2, the size of which depends on the number of external teeth 4 of the gearwheel 2 and is 180° divided by the number of external teeth 4. The third angle V1 of this triangle is in each case 90° or less. The angle V1 is connected with the number of recesses 8 in so far as the product of the number of recesses 8 per roller 6 and the angle V1 makes exactly 180°. With four recesses 8 in the roller 6, the angle V1 is therefore 45°.

The number of four recesses 8 in the rollers 6 ensures, on the one hand, that the number of recesses 8 is as small as possible, that is, the available bearing surface of the rollers 6 in the annular gear 3 is large enough. On the other hand, however, without undue complexity it also ensures that there is an opportunity for all the external teeth 4 of the gearwheel 2 to engage with the rollers 6. The roller radius is selected here so that it is about 3.0 to 4.5 times the eccentricity E, that is, the spacing of the midpoints MR and MK of annular gear 3 and gearwheel 2.

The number of recesses and the number of external teeth 4 are interdependent. The number of external teeth 4 is at least double the number of recesses 8 per roller 6 divided by two less than the number of recesses 8 per roller 6. In this present case, the number of external teeth 4 was even increased, because it has been shown that a count of at least six external teeth 4 fulfils the requirements in respect of wear and noise generation even better than the minimum requirement.

When the gearwheel 2 now rotates inside the annular gear 3, the tooth tips of the external teeth 4 each come into engagement with a recess 8. The start of such a movement is illustrated, for, example, for the roller 6' and the external tooth 4', the gearwheel 2 rotating in the direction of the arrow 11 relative to the annular gear 3. Since the radii RZ of the tooth tips 4 and the recesses 8 are identical, a cylinder now lies in a hollow cylinder, producing a relatively large area of contact between external tooth 4 and internal tooth 5. On further rotation of the gearwheel 2 in the annular gear 3, the tip of the external tooth 4 is turned in the recess 8. Although this generates friction between the external tooth 4 and the roller 6, this friction is no longer critical because, on the one hand, the recess 8 is wetted by the hydraulic fluid to be conveyed and, on the other hand, the pressure between the external tooth 4 and the roller 6 is distributed over a relatively large area, so that no noticeable wear occurs. On further rotation, the external tooth 4 of the gearwheel 2 remains in engagement with the recess 8 of the roller 6 and so turns the roller 6 in the annular gear 3. When the external tooth 4 disengages from the roller 6, it has turned the roller 6 sufficiently far for the following recess 8 of the roller to be available for receiving a new external tooth 4 again. On rotation of the roller 6, hydraulic fluid trapped in the recesses 8 also reaches the space between the annular gear 3 and the roller 6, with the result that the area of contact between these two parts is lubricated. At the same time, the fluid that has penetrated contributes to producing the seal.

As a consequence of the external teeth 4 engaging in the recesses 8 of the rollers 6, during the entire period for which external teeth 4 and internal teeth 5 are in contact with one another, an excellent seal can be guaranteed between adjacent chambers, which are formed by the contacts between external teeth 4 and internal teeth 5.

We claim:

1. A hydraulic machine having an annular gear with a set of internal teeth and a gearwheel with a set of external teeth mounted eccentrically therein, the internal teeth having one more tooth than the external teeth, and the teeth of at least one set of teeth being formed by rotatably mounted rollers, and in which each roller has at least three axially parallel recesses in a surface of the roller in which the teeth of the other set of teeth engage, each recess being bounded by a surface corresponding to a part of a cylinder and the teeth of the other set have a continuous convex surface over the major portion of each tooth.

2. A machine according to claim 1, in which the teeth of the other set of teeth have convex part-cylindrical tips, the cylinder envelope of the recesses having a radius corresponding to the radius of a cylinder defining tips of the teeth.

3. A machine according to claim 1, in which the recesses have a depth 10% of the radius of the rollers.

4. A machine according to claim 1, in which the rollers are arranged in the annular gear.

5. A machine according to claim 1, in which at least four recesses per roller are provided, each roller being received over more than 180° of its circumference by the annular gear.

6. A machine according to claim 1, in which the roller has a radius which is in the range of 3.0 to 4.5 times the spacing of the midpoints of the annular gear and gearwheel.

7. A machine according to claims 1, having at least six external teeth.

8. A machine according to claim 1, in which the product of the number of recesses per roller and an angle which, when the gearwheel and annular gear are positioned so that a connection of the roller midpoint and the gearwheel midpoint lies exactly halfway between two external teeth, is formed between a connection of the roller midpoint and the gearwheel midpoint and the connection of the roller midpoint and the midpoint of the cylinder defining the tooth tip, is exactly 180°.

9. A machine according to claim 8, in which the number of teeth of the gear wheel is at least double the number of recesses per roller divided by two less than the number of recesses per roller.

* * * * *